US005241463A

United States Patent [19]

Lee

[11] Patent Number: 5,241,463

[45] Date of Patent: Aug. 31, 1993

[54] CONTROL SYSTEM FOR GAS BURNERS

[75] Inventor: Duane A. Lee, Springfield, Tenn.

[73] Assignee: White Consolidated Industries, Inc., Cleveland, Ohio

[21] Appl. No.: 361,508

[22] Filed: Jun. 5, 1989

[51] Int. Cl.[5] ..... G06F 15/46; F24C 3/00

[52] U.S. Cl. ..... 364/400; 126/39 E; 126/39 BA

[58] Field of Search ..... 364/188, 189, 400, 477, 364/557; 126/39 E, 39 BA, 1 R, 52; 431/18, 24, 25, 27, 29, 66-73

[56] References Cited

U.S. PATENT DOCUMENTS

| | | | |
|---|---|---|---|
| 4,391,265 | 7/1983 | Chen | 126/39 E |
| 4,444,551 | 4/1984 | Mueller et al. | 431/66 |
| 4,518,345 | 5/1985 | Mueller et al. | 431/66 |
| 4,604,046 | 8/1986 | Mueller et al. | 431/66 |
| 4,615,282 | 10/1986 | Brown | 431/66 |
| 4,812,963 | 3/1989 | Abrecht et al. | 364/400 |
| 4,914,566 | 4/1990 | Steutermann | 364/167.01 |
| 4,925,386 | 5/1990 | Donnelly et al. | 431/66 |
| 4,930,488 | 6/1990 | Pearman et al. | 126/39 BA |
| 4,993,401 | 2/1991 | Diekmann et al. | 431/66 |
| 4,997,161 | 3/1991 | Hutchison et al. | 126/39 E |

*Primary Examiner*—Jerry Smith
*Assistant Examiner*—Thomas E. Brown
*Attorney, Agent, or Firm*—Pearne, Gordon, McCoy & Granger

[57] ABSTRACT

A top gas burner control employs touch keypads to provide operator input signals to a microcomputer. The microcomputer controls reversible gear motor to operate gas burner valves, and the positions of the shafts of the valves are fed back to the microcomputer via decoders. The initial operation of a burner requires the operator to touch and ON keypad, in response to which the microcomputer rotates the shaft of the valve to a maximum open position and energizes an igniter at this position. The operator must the touch a further keypad within a predetermined time in order to prevent the microprocessor from closing the valve.

8 Claims, 7 Drawing Sheets

CONTROL SYSTEM FOR GAS BURNERS

This invention relates to a control system for gas burners, and is especially directed to an improved gas burner control system for domestic ranges, and the method for controlling such appliances.

BACKGROUND OF THE INVENTION

While touch controls have been used with various appliances, such as electric ranges, the convenience of such controls has not heretofore been available for gas top burner controls.

SUMMARY OF THE INVENTION

Briefly stated, the present invention provides a control system for gas burners, wherein the user operates the control system through a touch keypad. A control circuit which may include a microcomputer applies outputs to one or more motor-driven gas valves which, in turn, drive encoders that feed gas valve angular status information back to the microcomputer. The gas valves feed the selected amount of gas to the burners, which may be range top burners. When a gas valve is initially opened, the microcomputer energizes an igniter at a predetermined rotational displacement of the gas valve control. The operator may then terminate the sparking produced by the igniter, and increase or decrease the gas flow rate via the touch keypad. A master switch is provided for enabling the operator to turn off all gas in the event of an emergency or for other reasons, such as disabling the appliance so that it cannot be used by small children.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
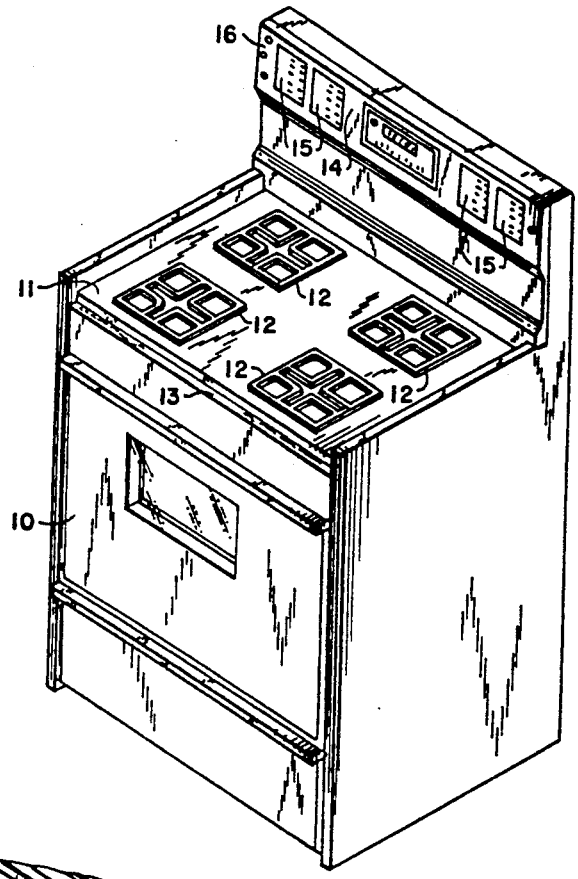
FIG. 1 is perspective view of an oven-range combination that may be employed in accordance with the invention.
Figure 2:
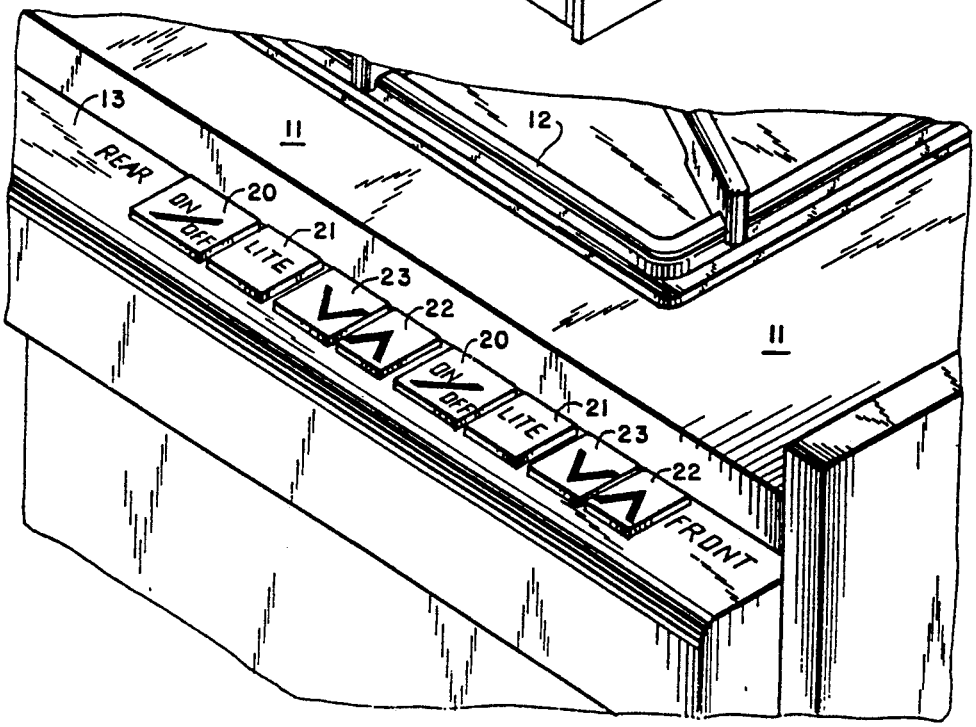
FIG. 2 is an enlarged view of a portion of the appliance of FIG. 1.

Referring now to the drawings, and more in particular to FIGS. 1 and 2, therein is illustrated a domestic gas cooking appliance in accordance with the invention, having an oven compartment with a door 10, and a range top 11 with four burners 12. A control panel 13 is provided at the front edge of the range top, and an indicator panel 14 is provided at the rear of the range top. The rear panel 14 has a separate bar-type indicator 15 for each of the burners, and a master ON/OFF switch 16 for shutting off electrical power to the burner control and gas flow to the top burners. Oven controls are not specifically shown herein, and may be of conventional type.

Each of the top burners 12 is provided with a separate touch keypad section in the control panel. As illustrated more clearly is FIG. 2, which shows the control panel 13 portion for the right front and right rear burners, each burner has associated therewith an ON/OFF keypad 20, a LITE keypad 21 for turning the respective igniter on or off, an INCREASE keypad 22, for example showing an upwardly directed arrow, for increasing the gas flow, and a DECREASE keypad 23, for example showing a downwardly directed arrow, for decreasing the gas flow.

Figure 3:
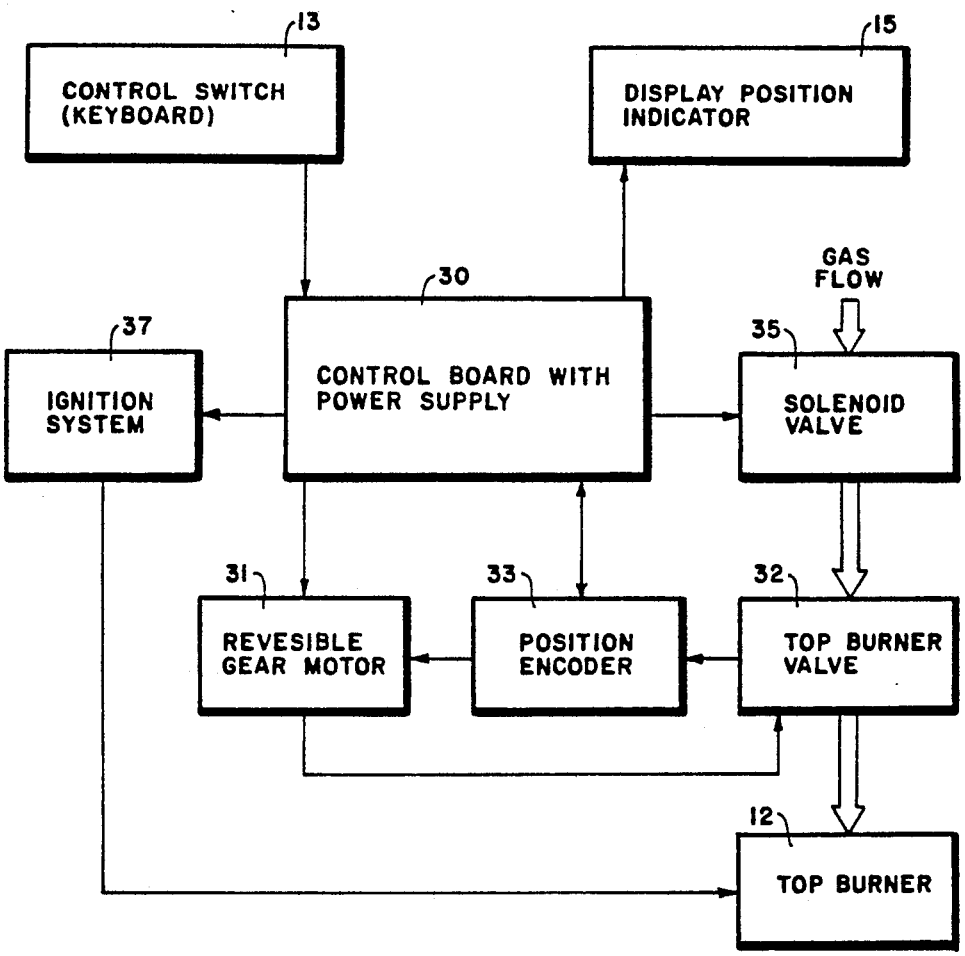
FIG. 3 is a block diagram of the control system of the appliance.

FIG. 3 is a block diagram illustrating the control system of the invention in a general manner. In this system, the electronic control for the system is effected by the components on a control board 30 which may be mounted in the rear of the appliance. The control board preferably comprises a microcomputer and a power supply for the system. The control board controls a reversible gear motor 31 for each of the gas burner valves 32. The valves 32 have shafts or other position indicating elements that control position encoders 33 to apply a coded signal, such as a digital signal, to the control board indicative of the position of the respective valve. The position encoders may also be connected to supply the operating voltage to the motors 31.

Figure 8:
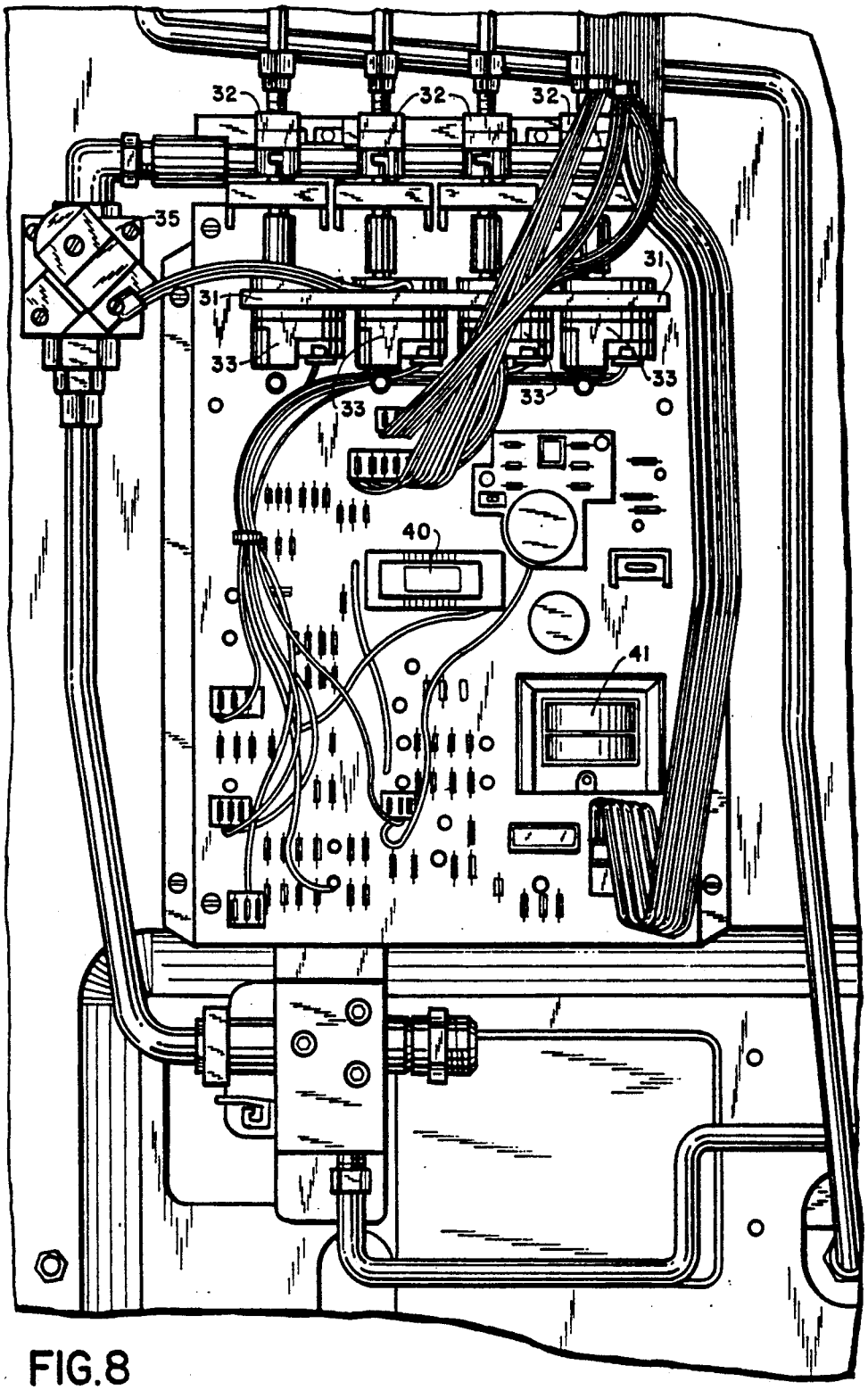
FIG. 8 is an illustration of the rear of the appliance illustrated the mounting positions of various elements in accordance with a preferred embodiment of the invention.

It is especially advantageous to physically mount the motors 31, burner valves 32 and position encoders on the same circuit board as the control system and power supply, as illustrated for example in FIG. 8.

The control board further includes controls for controlling a main solenoid valve 35 so that the gas supply is also cut off by this valve when no keypads have been operated to use the burners, and in the event of faults, etc. The control board also controls the energization of the ignition system 37, as well as the indicator 15, and receives control signals from the keypads of the control panel 13.

Figure 4:
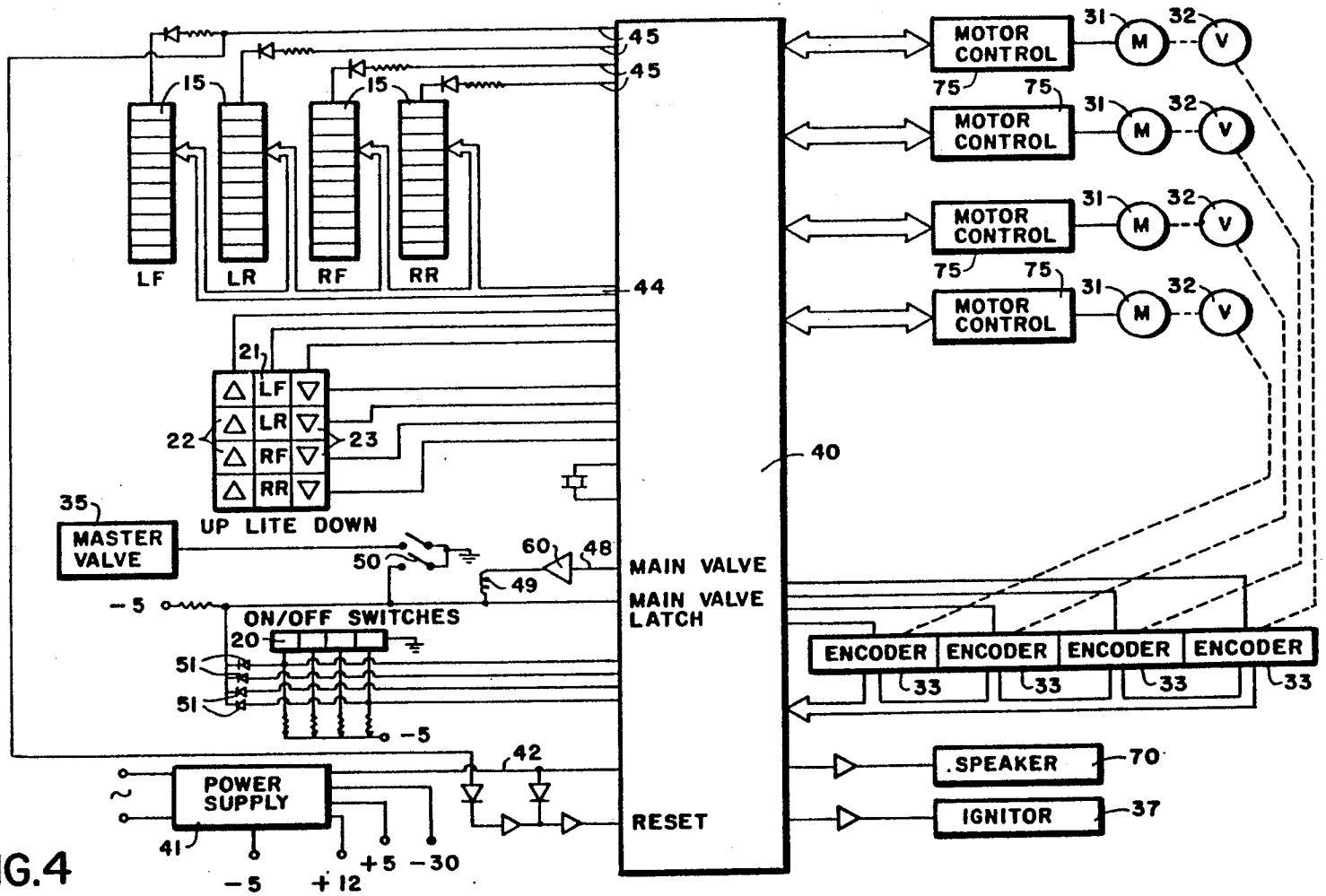
FIG. 4 is a more detailed block diagram of the control system of the invention.

A preferred embodiment of the system of the invention is illustrated in FIG. 4 employing a microcomputer 40 for example of type HMCS404C. A power supply 41 to the AC mins supplies the DC operating voltages for the system, as well as an AC reference for the microcomputer on the line 42.

Port 44 of the microcomputer is coupled to control the valve position indicators 15, which may be bar displays, so that each indicator displays a bar of length corresponding to the gas flow of the respective burner. The indicator controlled at any instant is controlled by the select lines 45.

The keypads 21, 22, 23 may be connected in a matrix, as illustrated, with the leads of the matrix being separately connected to the microcomputer so that the microcomputer can sample the keypads in conventional manner to determine if a key pad has been touched.

The ON/OFF keypads 20 are connected to ground separate lines of the microcomputer, when touched, so that the microcomputer can sample these inputs in accordance with its program, to effect the turning of the respective gas burner on or off.

Figure 4A:
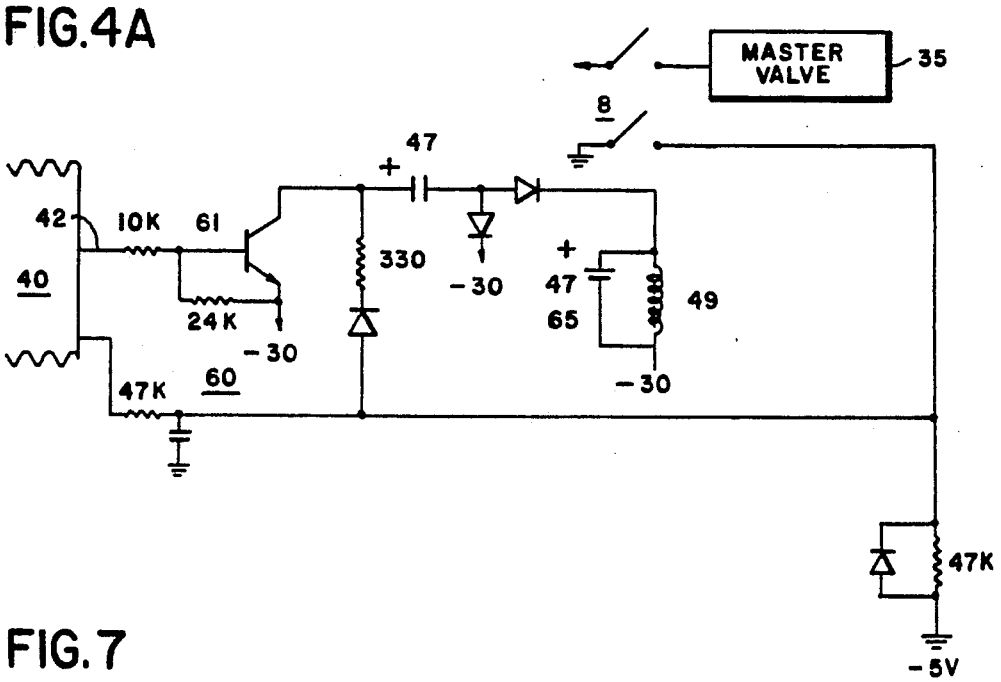
FIG. 4A. is a circuit diagram of an amplifier employed in the circuit of FIG. 4.

Control output 42 of the microcomputer controls a relay 49, via an amplifier circuit 60, to energize the master solenoid valve 35. The amplifier circuit 60, which is illustrated in greater detail in FIG. 4A, has a transistor 61 coupled to the microcomputer via the line 42, for receiving master valve energization pulses. These pulses are applied from the collector circuit to the coil of relay 49. The master valve cannot be initially opened unless the microcomputer has received an ON signal from the keypad. Since the relay 49 is capacitively coupled to the microcomputer, repetitive pulses are required, as provided by the program of the microcomputer, to maintain the relay 49 energized, and hence to maintain the master valve open. The relay circuit is provided with a capacitor so that current can be maintained in the coil 49 for the period between adjacent energization pulses. In the absence of such a pulse for a predetermined time, however, the relay will be deenergized and the master valve shut off. Such deenergization may be as a result of the microcomputer program, for example to close the master valve whenever none of the burner valves is open or in the event of a detected fault in the system, and it will automatically occur upon a loss of operating power.

Referring again to FIG. 4, the microcomputer is also connected to the igniter 37 to effect the energization of the igniter at predetermined times in accordance with the program, as will be discussed in greater detail. The microcomputer may also be connected to an audio output device such as the speaker, in order to enable operating signals such as beeps to advise the operator of the appliance of various operating conditions of the system. For example, a single beep may be produced upon any touching of a keypad that could validly result in operation of the system. Thus, touching of any keypad when the master switch is off would not result in an audio output.

The reversible motors 31 are controlled by the microcomputer 40 via separate control circuits 75, the motors in turn controlling the opening positions of the valves 32. The valves 32 are mechanically coupled to the encoders 33, which may be rotary digital encoders, for applying signals corresponding to the valve angular positions to the microcomputer. Thus, the microcomputer energizes the motors and rotate in determined directions to achieve selected angular positions of the valves as indicated by the output signals from the encoders.

Figure 5:
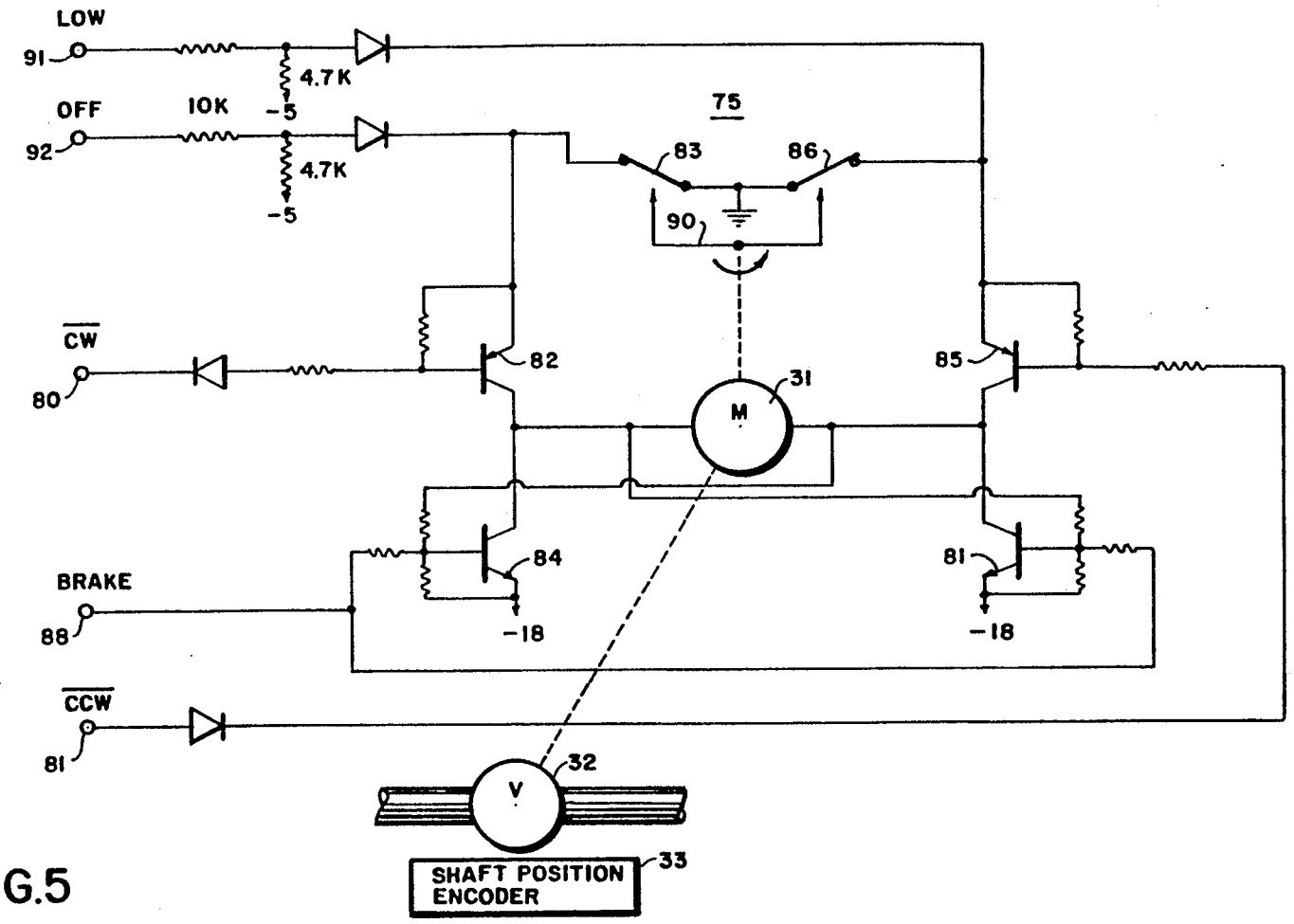
FIG. 5 is a circuit diagram of the motor control arrangement that may be employed in the system of FIG. 4.

A preferred motor control system is illustrated in greater detail in FIG. 5, wherein the motor is controlled to rotate in the clockwise or counter clockwise signals by input signals from the microcomputer on lines 80, 81 respectively. The clockwise rotation signal establishes a conduction path from the negative supply through transistor 81, the motor 31, transistor 82, and contact 83 to ground. Similarly, the counterclockwise rotation signal establishes a conduction path from the negative supply through the transistor 84, the motor, the transistor 85, and the contact 86 to ground. The two paths direct current in the motor in opposite directions.

A brake input to the circuit, from the microcomputer, at terminal 88, renders the transistors 81 and 84 both conductive, to place the terminals of the motor at the same potential, and hence brake the motor.

The contacts 83, 86 are encoder operated limit contacts which are opened at respective opposite limits of rotation of the motor 31 by a encoder wheel 90. The opening of the contacts thus opens the ground connection to the motor, and ceases energization of the motor for further movement in the respective direction. The opening of these contacts also effects a signal level change at the terminals 91, 92, to signal the microcomputer that a limit has been reached. These terminals are labelled LOW and OFF respectively in view of the characteristics of the burner valves, as will be discussed.

The microcomputer constantly monitors the keypads and the remainder of the system, and in the event of a fault is programmed to shut the entire system down, i.e. with the gas shut off.

Figure 7:
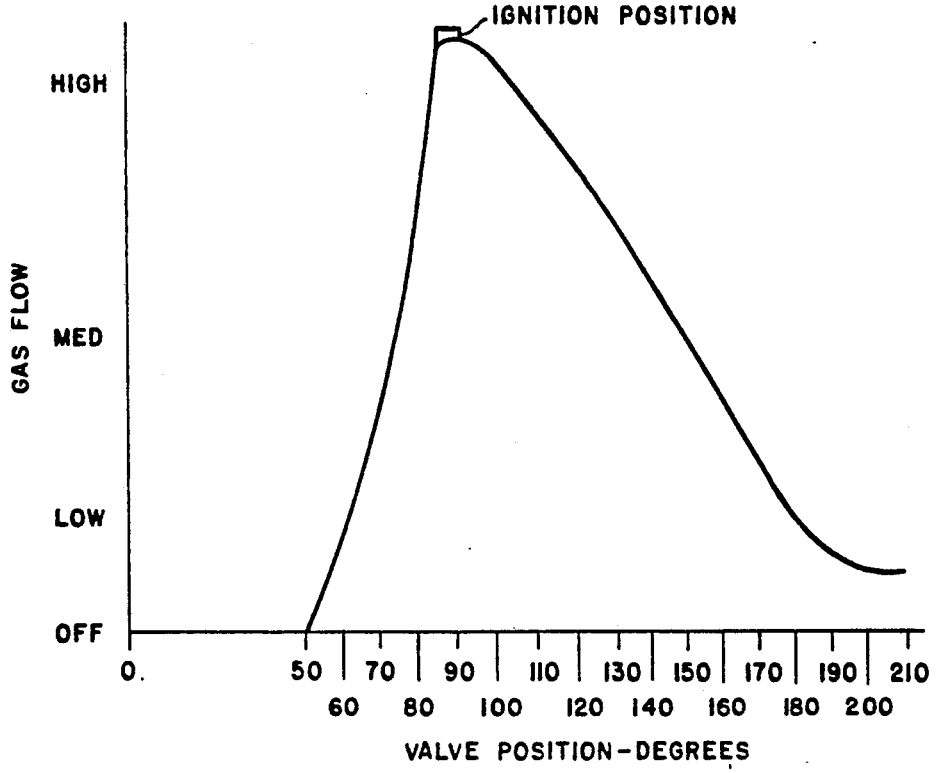
FIG. 7 is a graph illustrating the ignition characteristics of the control system.

The gas valves have flow characteristics, as a function of angular displacement of the control shaft thereof, as illustrated in FIG. 7. Thus the gas flow is shut off from the initial position of 0 degrees to about 50 degrees, at which point it opens rapidly upon further angular displacement of the shaft until at about 90 degrees the valve is fully open for maximum gas flow. During the initial turning on of a valve in response to the touching of an ON/OFF keypad, and lite keypad the microcomputer effects the rotation of the valve shaft to 90 degrees for maximum flow, and holds the valve at this position while it energizes the igniter 37. Upon ignition of the gas at the respective burner, the operator depresses the LITE, INCREASE or DECREASE 21, 22, 23 switches to deenergize the igniter. Thereafter the operator may touch the INCREASE and DECREASE keypads 22, 23 to obtain the desired level of gas flow, such desired flow being indicated on the indicator 15. The microcomputer controls the motor, and hence the burner valve, to achieve this flow, and the attaining of the desired flow is verified by the output of the encoder 33.

Upon continued rotation of the valve stem, as illustrated in FIG. 7, the gas flow is gradually reduced until the LOW flow thereof is attained at about 200 degrees. The rate of decrease of flow with displacement in the portion of the control is much lower that the rate of increase of flow with displacement in the initial opening of the valve.

Figure 6:
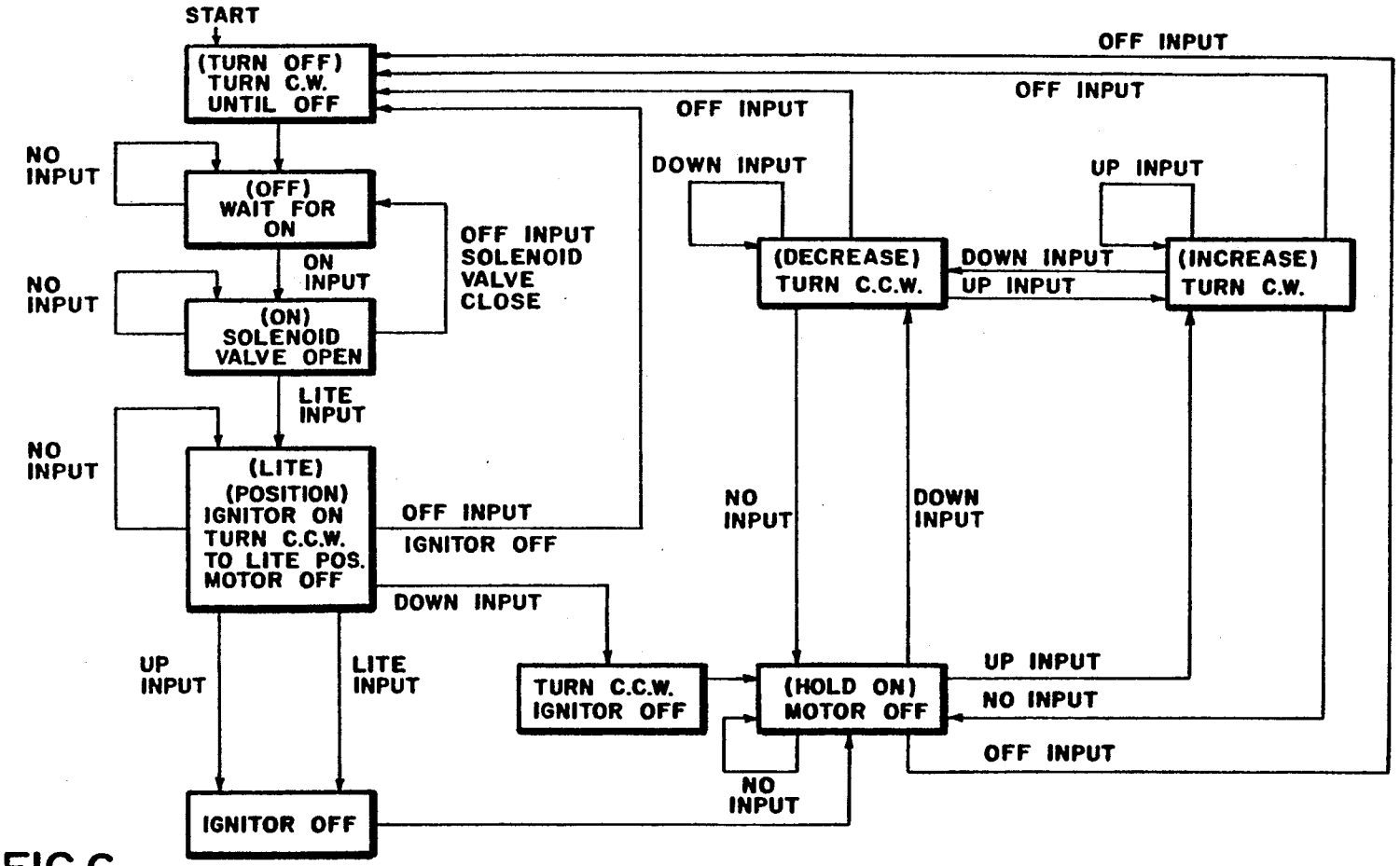
FIG. 6 is a flow diagram in accordance with the invention.

FIG. 6 illustrates as flow diagram of the operation of the control system in accordance with the invention. In order to use a burner, the operator must perform two operations. First the respective ON/OFF keypad must be touched, and then the LITE, keypad must be touched. If the LITE keypads has not been touched within a predetermined time following the touching of the ON/OFF keypad, the program will be reset to the off condition. Upon touching either the LITE or INCREASE keypads, the igniter will be turned off, and the motor will be maintained deenergized so that maximum gas flow is maintained. If, however, the DECREASE keypad had been touched, the igniter will be turned off and the gas flow will be reduced by control of the respective motor.

Thereafter the system is responsive to touching of the INCREASE and DECREASE keypads for causing the respective burner valve to increase and decrease its gas flow. If the ON/OFF keypad is touched again, however, the program will jump to a shutdown routine, turning the motor shaft clockwise to return to the off position with the gas valve closed.

In the program of the microprocessor, at the off position the microcomputer compares the off position code of the encoders, in order to verify the valve shaft position. At the LITE position, i.e. about 90 degrees displacement, the microcomputer checks to ensure that this position has been reached within 10 seconds, and will shut down the system if this condition has not been met. The microcomputer also determines if the OFF condition has not been reached within 10 seconds from an OFF command, and also shuts down the system if this condition is not met.

In order to emphasize the operating conditions of the appliance to the operator, the program may control the position display to flash at a rapid rate when the ON/-OFF keypad is first touched, and to flash at a slower rate when the igniter is energized, so that the operator is advised of the need to touch the LITE keypad as soon as the burner is lit. After the igniter has been deenergized, the display will be continuous, to indicate gas flow, and hence heat level, of the burner.

In one embodiment of the invention, the gear motors 31 were 6 rpm motors with a torque rating of 29 in-oz, manufactured by Buehler Products, Inc., of West Germany. The igniter may be a conventional igniter, or, alternatively, a glow coil. The gas burner valves may be manufactured by Sourdillon of France, which is a 210 degree proportional valve.

If necessary, a suitable conventional flame detector may be provided, coupled to the microcomputer to provide a "proof of flame" to the system. The system may also encorporate a reignition control, if desired.

While the invention has been specifically described as employing a gas valve in which the full flow position is intermediate the low flow and off positions, it is apparent that a gas valve may alternatively be employed in which the low flow position is intermediate the off position and the position at which full flow and ignition occurs. The valve position may alternatively be sensed with minature switches, operated for example with multiple cams, for sensing the limits of the valve positions, with potentiometers being employed to provide signals for controlling the display.

In a further modification of the invention, especially adapted to the embodiment of the invention employing valves having full flow positions intermediate the low flow and off positions, the program may be responsive to operator control for turning off the last currently lit burner, for controlling the main gas valve to be immediately opened. This eliminates the necessity for increasing the gas flow, and then decreasing it, if the last currently lit burner had been set to an intermediate or low flow position.

In a further modification of the invention, multispeed motors may be employed, controlled in the same manner as above described, that are controlled by the program to move at a high speed from the OFF to the LITE positions, or during a return to the OFF position after use, while moving at a slow speed for other settings. Such motors may have taps controlled by the microprocessor for controlling the motor speed.

Instead fo the specific Keypad control system above described, using ON/OFF, LITE, INCREASE and DECREASE Keypads, it is apparent that other arrangements may be employed. For example, in a three keyboard system, using ON/OFF, INCREASE and DECREASE Keypads, the first depression of the INCREASE or DECREASE Keypads effects the starting of the movement of the motor and valve, if the preceding operation was a depression of the ON/OFF Keyboard. The next subsequent depression of the INCREASE or DECREASE Keypads completes the ignition process and turns off the igniter. After this, the INCREASE and DECREASE Keypads function to control increases and decreases in gas flow.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. A gas burner system for a gas cooking range including a gas burner, a gas supply, an electric igniter for said burner, a valve for controlling the flow of combustible gas from said gas supply to said burner, said valve having a rotatable valve shaft, a control system for said gas valve and said igniter comprising a motor mechanically coupled to rotate said shaft, a microcomputer connected to control said motor, a shaft position encoder coupled to said shaft and connected to said microcomputer to supply a digital signal to said microcomputer indicating the angular position of said shaft, first and second operator controllable switches coupled to said microcomputer, said microcomputer comprising means responsive to operation of said first switch for energizing said motor to turn said shaft in a first direction and means responsive to operation of said second switch for energizing said motor to turn said shaft in a second direction opposite said first direction, a third operator controllable switch operable to energize said motor to rotate said shaft to a maximum flow position of said valve and to energize said igniter, and means responsive to operation of any of said first, second and third switches to deenergize said igniter.

2. A gas burner system as set forth in claim 1, further comprising a position indicator coupled to said microcomputer, said microcomputer including means for displaying the angular position of said shaft on said position indicator.

3. A gas burner system as set forth in claim 1, further comprising an on/off switch coupled to said microcomputer, a master valve connected to supply gas to said gas valve, and circuit means coupled to said microcomputer for controlling said master valve in response to said on/off switch.

4. A gas burner system as set forth in claim 3, wherein said microcomputer includes means to close said master valve if said ignitor is not deenergized within a predetermined time after said third operator controllable switch energizes said ignitor without subsequent operation of either said first, second or third switches.

5. A gas burner system for a gas cooking range including a gas burner, a gas supply, an electric igniter for said burner, a valve for controlling the flow of combustible gas from said gas supply to said burner, said valve having a rotatable valve shaft rotatable between two angularly spaced positions, a control system for said gas valve and said igniter comprising a motor mechanically coupled to rotate said shaft, a microcomputer connected to control said motor, a shaft position encoder coupled to said shaft and connected to said microcomputer to supply a digital signal to said microcomputer indicating the angular position of said shaft, said encoder having switch contacts operable to control said motor to limit rotation of said shaft to the space between said two angular positions, first and second operator controllable switches coupled to said microcomputer, said microcomputer comprising means responsive to operation of said first switch for energizing said motor to turn said shaft in a first direction and means responsive to operation of said second switch for energizing said motor to turn said shaft in a second direction opposite said first direction, a third operator controllable switch operable to energize said motor to rotate said shaft to a maximum flow position of said valve and to energize said igniter, and means responsive to operation of any of said first, second and third switches to deenergize said igniter.

6. A gas burner system as set forth in claim 5, further comprising an on/off switch which must be operated to the on position prior to operation of said third operator controllable switch to turn said burner on.

7. A gas burner system as set forth in claim 6, wherein said on/off switch when operated in the off position turns said valve to the off position.

8. A gas burner system as set forth in claim 7, wherein said system includes a master valve connected to supply gas to said gas valve and operable by said on/off switch.

* * * * *